US006918200B2

(12) United States Patent
Pena

(10) Patent No.: US 6,918,200 B2
(45) Date of Patent: Jul. 19, 2005

(54) BILLBOARD MANUFACTURE AND SUPPORT ASSEMBLY

(76) Inventor: John Pena, 932 S. Van Horne, West Covina, CA (US) 91790

( * ) Notice: Subject to any disclaimer, the term of this patent is extended or adjusted under 35 U.S.C. 154(b) by 0 days.

(21) Appl. No.: 10/423,106

(22) Filed: Apr. 25, 2003

(65) Prior Publication Data

US 2004/0163291 A1 Aug. 26, 2004

Related U.S. Application Data

(63) Continuation-in-part of application No. 10/285,816, filed on Nov. 1, 2002, and a continuation-in-part of application No. 10/087,680, filed on Feb. 28, 2002, now abandoned.

(51) Int. Cl.[7] ..... G09F 17/00
(52) U.S. Cl. ..... 40/591; 40/592
(58) Field of Search ..... 40/591, 592, 588, 40/589, 590, 597, 600, 601, 606.04, 606.15, 643

(56) References Cited

U.S. PATENT DOCUMENTS 2,812,605 A * 11/1957 Whaley ..... 40/591
3,161,973 A 12/1964 Hastings
3,802,103 A 4/1974 Neff
4,800,663 A 1/1989 Zeigler
5,365,687 A 11/1994 Sclater
5,415,451 A 5/1995 Stanton
5,438,780 A * 8/1995 Winner ..... 40/514
6,122,850 A 9/2000 Strzeletz
6,161,320 A 12/2000 Peterson

* cited by examiner

*Primary Examiner*—Mark T. Le
(74) *Attorney, Agent, or Firm*—Christie, Parker & Hale, LLP

(57) ABSTRACT

A display assembly for attachment to a vehicle is provided that includes a panel assembly for receiving a display leaf; and a strap assembly connected to the panel assembly. The strap assembly is removably connected to a roof rack to removably mount the display assembly to the vehicle. This allows the panel assembly to extend downwardly along a side of the vehicle, such that the direction of travel of the vehicle is substantially in the vertical plane of the panel assembly.

30 Claims, 9 Drawing Sheets

BILLBOARD MANUFACTURE AND SUPPORT ASSEMBLY

CROSS-REFERENCE TO RELATED APPLICATIONS

This application is a continuation-in-part of U.S. patent applications Ser. No. 10/285,816, filed Nov. 1, 2002 and 10/087,680 filed Feb. 28, 2002, now abandoned.

TECHNICAL FIELD

This invention is related to billboard manufactures and is particularly directed to not only to a portable billboard manufacture readily and easily securely mountable to or removable from a vehicle, to or from a static structure, or to or from any structure outside of the manufacture itself, for observing the manufacture's display, but also to the supporting assembly for a portable billboard manufacture and by which a manufacture may be mounted to a vehicle or static or other structure.

BACKGROUND TO THE INVENTION

Manufactures for exhibiting displays are disclosed in prior art manufactures found in U.S. Pat. Nos. 3,161,973; 3,802,103; 4,800,663; 5,365,687; 5,415,451; 6,122,850; and 6,161,320.

Present state-of-the-art display leafs on vehicles are traditionally or customarily already fixedly mounted in a frame mounted to a vehicle to which the display leaf's frame has been applied. The display leaf would be changed while its frame remained fixed to the vehicle which would be parked or stationary. Changes of the display leaf would require non-use of the vehicle for a length of time for making changes, by removing the old display leaf and installing a fresh or new display leaf in the vehicle-fixed frame. Considerable time in loss of use of the vehicle would result, while time was taken to remove and to replace the display leaf from its vehicular frame. Consequently, time for display that otherwise could be viewed on the vehicle was lost. Similarly, as to static structures, time after removal of a display leaf would result unless a new or fresh display leaf had been first prepared for immediate installation.

This invention provides for an efficient, easy, and quick change of a display leaf in a portable frame assembly which is removed from its vehicle or static structure and into a change mode for removing and installing an already prepared next display leaf. The change itself is made in a rapid period of time, as the fresh display is already prepared beforehand for installation in its portable manufacture which is already in its display location or is ready for immediate mounting to the vehicle or to a static structure. The loss of time of display in turn is substantially reduced to a minimal period. The portability of such a manufacture is a distinct advance made in the art of display panels, whether to and for moving vehicles or to a static structure to which the manufacture can also be securely mounted and be sustained thereon, as no substantial change is necessary in a vehicle's body, side walls, roofs, roof racks, or in a static structure. This noted beneficial change is also accomplished as well by the assembly of support elements to which the display leaf's frame is mounted to the vehicle or other structure.

SUMMARY OF THE INVENTION

This invention is embodied in a portable manufacture and a supporting assembly for it. A display support panel and a transparent frontal panel spaced from it form the manufacture, with a display leaf between them, the display leaf mounted to the support panel. A sealed spacing between the panels is provided when the manufacture is in its closed mode. The transparent panel is swingably mounted to the support panel along a pair of facing edges at boundaries for the panels. An endless U-shaped frame on which a gasket strip for sealing and spacing the panels is provided adjacent the boundaries or edges on the transparent panel. One or more closures or locking mechanisms are provided to maintain the panels in a sealed closed mode. Along lower boundaries for the manufacture, generally in the corresponding corners of such boundaries, suction members are securely mounted to the rearwall of the support panel for attachment to a side wall or other element(s) on the side of a vehicle or on a static structure to which the portable manufacture is applied and sustained thereby, while at upper boundaries of the manufacture a pair of hinged arms, adjustable in their lengths, having strap members connected to them at the ends of their adjustable portion or telescopic members are provided. The strap members encircle corresponding rack bars, as found on today's SUV's, station wagons, trucks, vans, etc., atop of or on the roof of the vehicle or to a suitable element(s) on a static structure. Rotatable bracket members are provided for the strap members and by which the strap members can make a 90-degree turn to encircle rack bars that are either parallel to the length of the vehicle or that traverse the width of the vehicle's roof. Pivotal folding braces connect the hinged arms to the rearwall of the support panel, whereby the straps, arms, and braces of the manufacture are collapsible against the rearwall of the support panel in the manufacture's closed mode, thereby providing ease of portability and storage for the manufacture when not utilized. Brackets are mounted to the top boundary of the support panel for an optional addition of a lighting fixture for dispersing light to the display leaf in the assembled condition of the portable manufacture.

Another embodiment of the invention is mounted to a tailgate of a vehicle, utilizing one or more flexible bands as arm(s) for looping over the top boundary of the tailgate to connect to a closure member(s) secured to the inner side of the tailgate. Aperture(s) at the end(s) of the arm(s) provide passage of the closure member(s) to grasp the embodiment along its upper boundary to the tailgate. A cabinet lock device secured to the transparent panel latches to the support panel through a slot in the support panel. Suction cup members are employed at the lower boundary of the embodiment for attachment to the exterior wall of the tailgate.

Another illustrative embodiment is mountable to a vehicle upon its rear trunk lid. This embodiment is an inversion of the tailgate embodiment in its application to a vehicle or static structure. With the flexible arms of the tailgate embodiment and a different kind of adjustable strap assemblies, but without the need of suction cup members, it is applicable to a rear truck lid's top and bottom edges on the rear of a vehicle.

A further embodiment of the invention is the addition of a solid wind-deflecting panel mounted to the support panel of the rear truck lid embodiment and which can be swung open to abut and extend across the top of the trunk lid and thereby re-direct such wind from between the support panel and the trunk's lid to a direction other than between the support panel and the top of the trunk lid, thereby reducing or eliminating detrimental wind forces that otherwise would strike the support panel.

Another embodiment envisions the application of strap and flexible band assemblies or strap assemblies themselves to a tailgate or a trunk lid and by which a display manufacture may be fitted to the rear of the vehicle whether with a tailgate or a trunk lid.

Yet another embodiment of the invention is drawn to the assembly of supporting elements adapted or applied to a shallow leaf-display manufacture having a support panel and transparent panel in a shallow relationship to one another and which includes an opening at a top or other boundary of the manufacture and through which the panel's leaf display may be introduced to the shallow spacing between the support and transparent panels.

Still another embodiment of the invention is drawn to an assembly of a backpanel to a display manufacture with slots, adjustable buckle assemblies looped to the slots, and hooks on the buckle assemblies, which is applied to a wheel well of a vehicle.

The inventive concept extends further to a support assembly of elements per se and adaptable to or applicable to a rearwall of a support panel for a display manufacture.

An object of this invention is to provide a novel display manufacture.

Another object of the invention is to provide a novel support assembly of elements adaptable to a display manufacture and by which the manufacture is made portable.

Another object of this invention is to provide portability to the display manufacture by a support assembly of elements which provides the portability of the manufacture from a vehicle or static structure to another vehicle or static structure.

A further object of this invention is to provide ease and quickness of change of a display leaf in a display manufacture.

Yet another object of this invention is to reduce the time period for removing and re-installing a display leaf thereby saving time, labor and costs associated with maintaining display leafs.

Still another object of this invention is to prevent danger of the display manufacture from being ruptured from its location on a rear trunk lid and which could cause damage or injury were the manufacture to separate from the vehicle.

Another object of the invention is to provide a display manufacture that is sustained by a vehicle or a static structure by its mounting thereto.

A further object of the invention is to provide a support assembly adaptable to a display manufacture which is interchangeable between or among different types or kinds of vehicles.

Still another object of this invention is to provide changeability of strap assemblies and hooking members for utilization on both tailgate and trunk lid applications.

These and other objects of the invention will become more apparent upon a full and complete reading of the following description, the appended claims thereto, and the accompanying drawing comprising eight (8) sheets of twenty-seven (27) FIGURES.

BEST MODE FOR CARRYING OUT THE INVENTION

Figure 1:
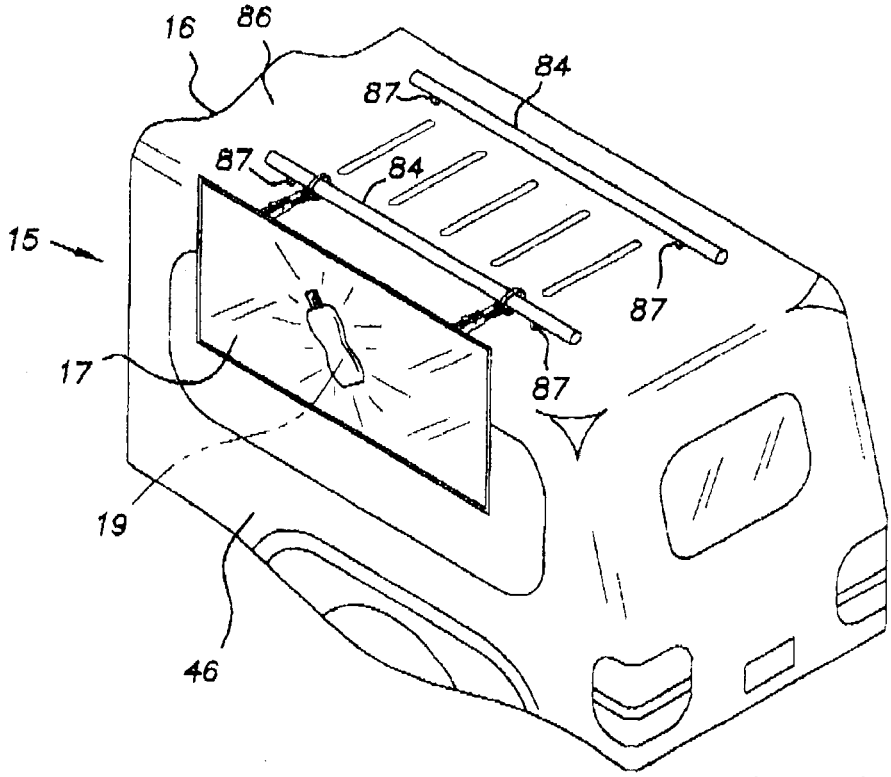
FIG. 1 is a perspective view from the top and to the rear and side of a vehicle on which the manufacture and supporting assembly of elements of the invention are installed in a closed and operational mode, the vehicle's roof rack being oriented longitudinally of the vehicle.
Figure 2:
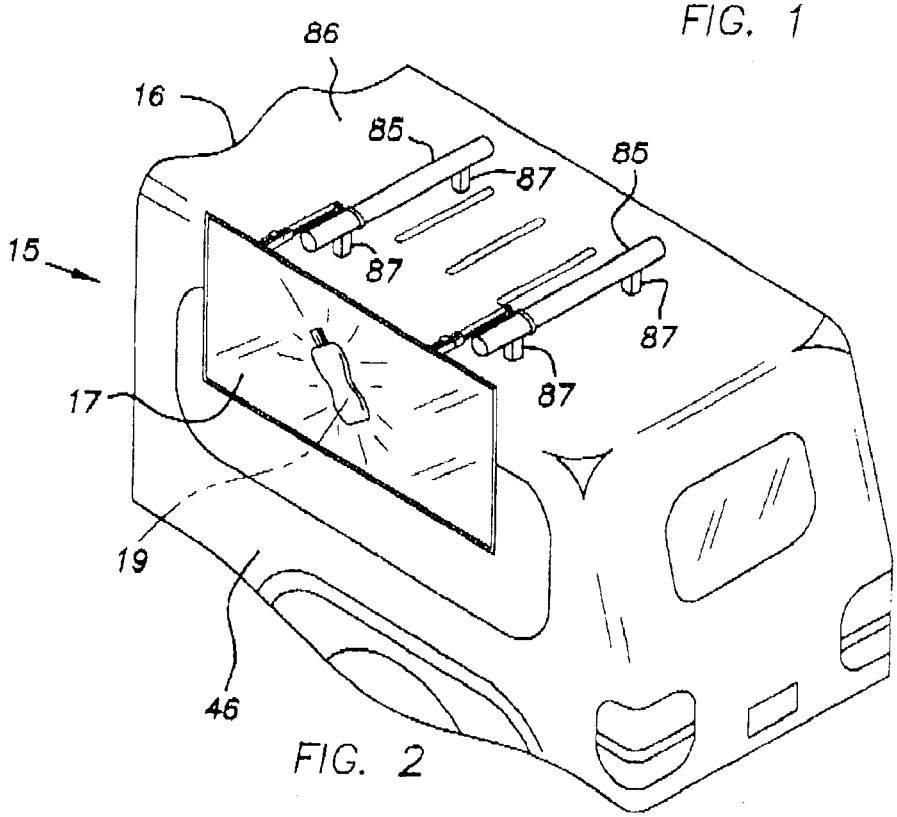
FIG. 2 is a perspective view from the top and to the rear and side of a vehicle on which the manufacture and its supporting assembly of elements of the invention is installed in a closed and operational mode, the vehicle's roof rack being oriented across the width of the vehicle.

FIGS. 1 and 2 illustrate an embodiment of the invention's manufacture 15 as it appears to a person viewing it in its operative mode on a vehicle 16, although the invention is suitable in an embodiment mounted in a similar manner to a static structure. Embodiment 15 embraces a transparent panel 17, under which a display leaf 18, FIG. 5, having a display 19, FIGS. 1, 2, integrated thereto is disposed and observed in such appearance. Display leaf 18 is positioned on a support or backing panel 20, FIG. 3, behind transparent panel 17 by suitable means such as glue, paste, tape, etc. Panels 20, 17 are of the same general size and congruent to one another in the assembly of embodiment 15, with transparent panel 17 positioned upon or over support panel 20. Panel 17 is formed from a transparent sheet, such as glass, vellum, plastic, or other suitable see-through material which is held in a planar fashion by means such as a stiff or rigid U-shaped frame 22, FIG. 5, customarily made from, for example, aluminum, which is sturdy and light-weight. U-shaped frame 22 includes, FIG. 5, an inner leg 23 facing display leaf 18 and which suitably tightly grips the inside surface of panel 17, and is preferably of a shorter length than its outer leg 24 that also suitable tightly grips the outside surface of panel 17. Backing panel 20 is formed from a solid material, such as, for example, from a sturdy and light-weight aluminum or other metal sheet, with a conventional endless flange (not shown) along its entire boundaries, top, bottom, and sides. A substantially endless extruded gasket 25, FIG. 5, is suitably securely mounted, such as by a strong adhesive, to the inside surface of transparent panel 17, above inner leg 23, to eliminate accumulation of moisture or condensation in spaced volume between panel 17 and panel 20 in the closed mode for manufacture 15 as gasket 25 seals against panel 20 in the closed mode for the panels.

Figure 4:
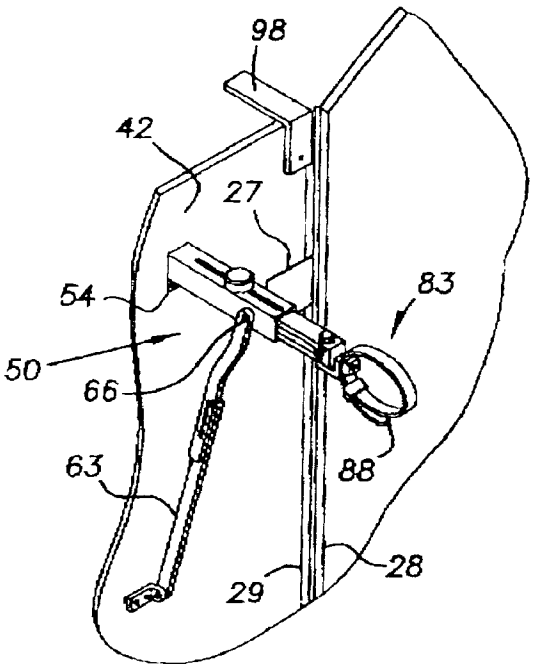
FIG. 4 is an enlarged view of a fragmentary portion of FIG. 3.
Figure 3:
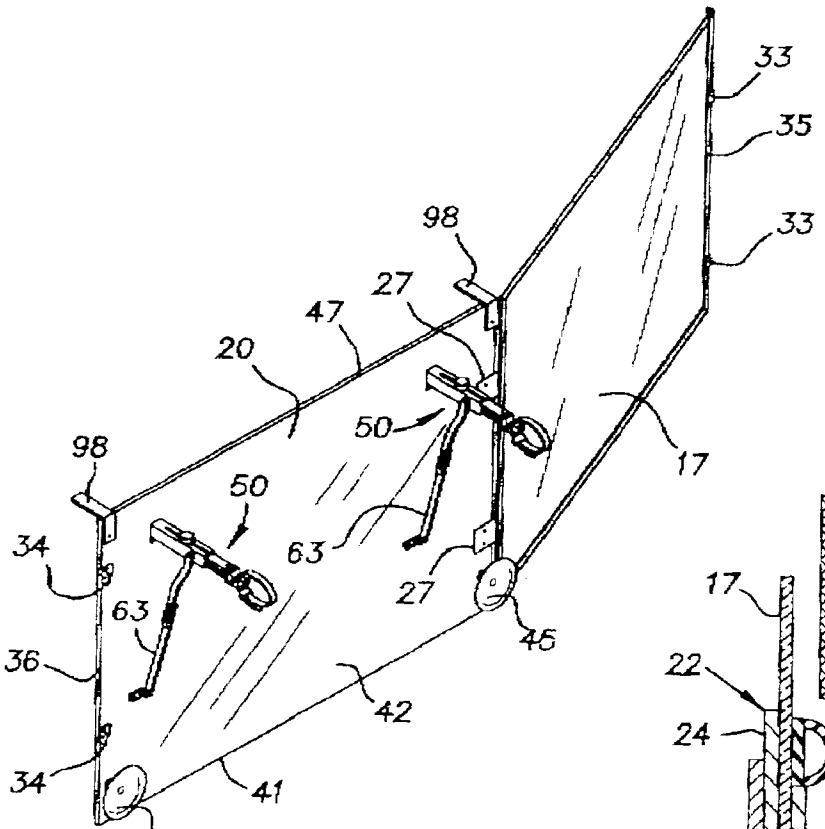
FIG. 3 is a perspective view of the FIGS. 1, 2 manufacture and its supporting assembly of elements in an open mode, viewed from above and to the rear of the support panel.

Panel 17 is joined to panel 20 in the assembled condition of manufacture 15 by means of a spaced pair of hinges 27, FIG. 3, 4, positioned along and secured to panels 17, 20 along facing boundaries 28, 29, FIG. 4, for panel 17 or frame 22 and panel 20. The panels 17, 20 suitably swing between a closed mode and an open mode on the hinges 27 and by which when in an open mode display leaf 18 can be removed, installed or changed.

Figure 5:
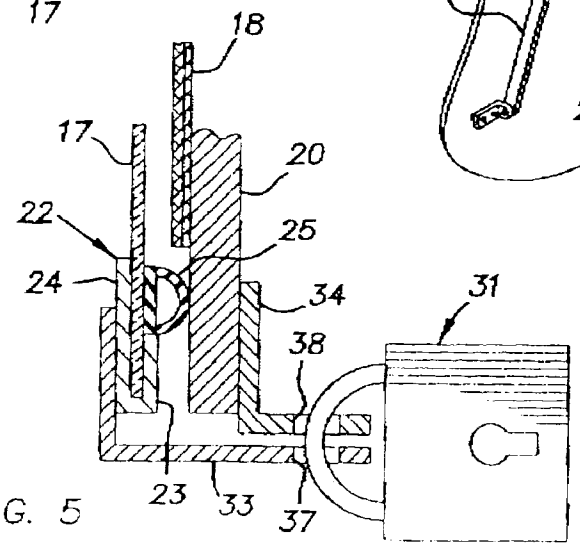
FIG. 5 is a fragmentary schematic cross-sectional view of the FIGS. 1, 2, 3 manufacture and assembly-support elements at a location along boundaries for scaling and for closure schemes for the assembled transparent and support panels in a closed mode.

A suitable closure mechanism, FIG. 5, such as a padlock 31, is provided at one or more locations, preferably two (2), for manufacture 15. L-shaped brackets 33, 34, FIGS. 3, 5, overlap one another in the manufacture's closed mode, and are respectively suitably secured at one (or more) spaced location(s) on the edges of panel 17 (or frame 22) and panel 20, along their facing boundaries 35, 36, FIG. 3, that oppose the joined facing boundaries 28, 29, FIG. 4. L-shaped brackets 33, 34 include holes 37, 38, FIG. 5, respectively, that align themselves to each other in the closed mode for manufacture 15 and by which padlock 31, or another suitable closure member locking or not necessarily locking the panels together, is introduced to maintain the closed mode for manufacture 15.

At a bottom or lower boundary 41, FIG. 3, of a rearwall or wall 42 of support panel 20, FIG. 3, adjacent the bottom's corners, here two (2) corners, each of a pair of suction cup members 44, 45 is suitably securely mounted to the rearwall 42 proximate to its corresponding corner. Suction cup members 44, 45 are of a customary circular configuration and of an attachable configuration and size for manufacture 15 that assures their suction strengths to hold up manufacture 15 to its mounted position on a sidewall 46, FIGS. 1, 2, of vehicle 16.

Proximate to an upper or top boundary 47 of rearwall 42 of support panel 20, FIG. 3, here two (2) corners, each of a pair of telescopic arms 50, FIGS. 3, 4, 7, 9, each positioned apart from the other, is connected to rearwall 42 of panel 20 in the assembled condition of manufacture 15. Each of arms 50 is formed of aluminum squared hollow tubings and includes a first tubing 53, FIGS. 7, 9, having at its one end a hinge 54 that attaches to rearwall 42, FIG. 6, and a second tubing 55 that is slidable within the first tubing 53 and by which the length of its arm 50 is adjustable by means of loosening and tightening a screw 57 (with washer not visible under its head) threaded (not visible) to the second tubing 55 through a slot 58 formed in a flat side 59 of the first tubing 53.

Figure 7:
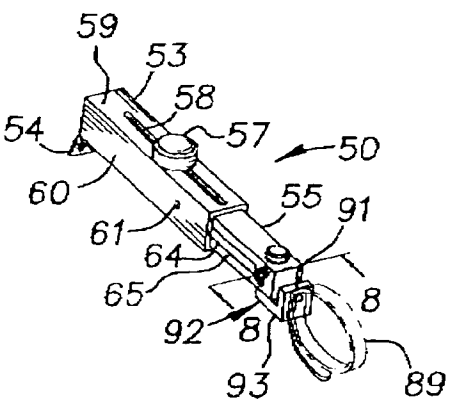
FIG. 7 is a perspective view of a hinged telescopic arm having a length-adjustable member, with a bracket and strap arrangement on its end.
Figure 6:
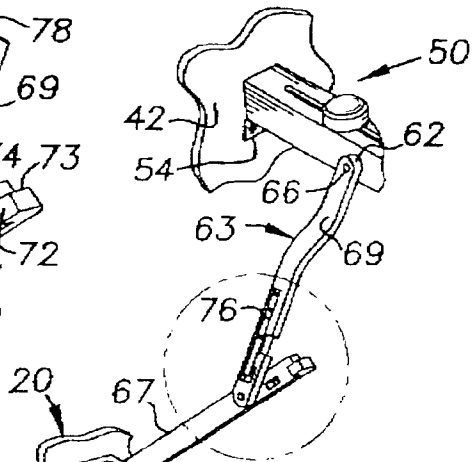
FIG. 6 is a perspective view of a foldable brace by which an arm (not necessarily telescopic in nature) is extended and locked in open and closed modes, respectively, for the supporting assembly of elements of the invention, the manufacture being collapsed in the closed mode.

At an adjacent side 60, FIG. 7, to side 59 in the first tubing 53, a hole 61 is formed as a pivot point for the one end 62, FIG. 6, of a foldable brace 63, FIGS. 3, 4, 6, riveted to hole 61. A slot 64, FIGS. 7, 9, is formed in the one side 65 of the second tubing 55 so that tubing 55 is slidable into and along tubing 53 about a rivet 66, FIGS. 4, 6, through hole 61 connecting brace 63 to the flat side 60 of the first tubing 53.

Figure 6A:
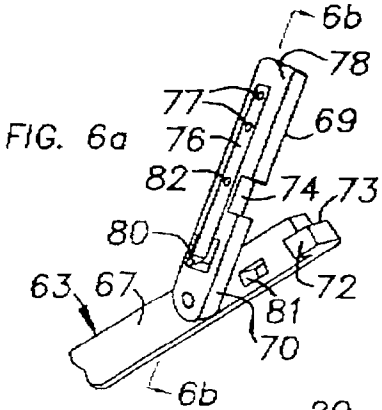
FIG. 6*a* is an exploded view shown within the phantom circle of FIG. 6 of the portion of links forming the brace of FIG. 6.
Figure 6B:
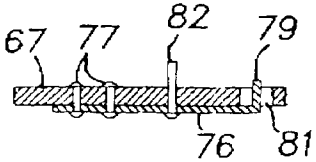
FIG. 6*b* is a view taken on line 6*b*—6*b* in FIG. 6*a*.
Figure 11:
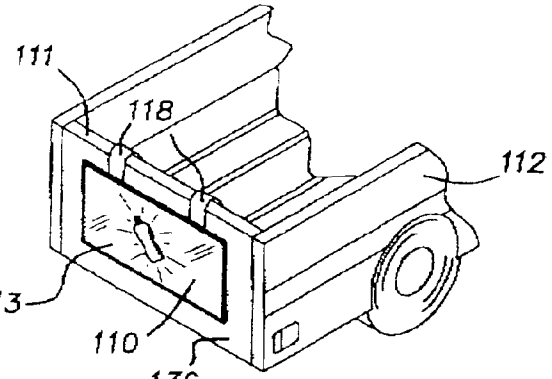
FIG. 11 is a perspective view above and from the rear of a vehicle of an embodiment of the invention mounted to a tail gate of the vehicle.

Foldable brace 63, FIGS. 6, 6*a* is one of a plurality, here two (2), of braces that lock arms 50, in the open mode for manufacture 15. Each foldable brace 63 is of a conventional type, such as for folding table legs, and is illustrated here in FIGS. 6, 6*a*, 6*b*, as exemplary of a customary type suitable in an embodiment of the invention. Each foldable brace 63 is formed of suitable rigid material, such as aluminum, steel or other metal, its first link 67 adjacent its one end being pivotally pinned to a bracket 68 secured to rearwall 42 of panel 20 and a second link 69 that is pivotally pinned adjacent its one end 70 to link 67 and pivotally pinned at 66 adjacent the brace's end 62 through hole 61 to side 60 of its corresponding arm 50. A latch 72 is formed on the free end 73 of link 67, latch 72 engaging a notch 74 along the length of link 69 to retain both links 67, 69 in a fixed alignment or straight-lined manner in the open mode. Latch 72 is bent or directed into the plane of link 67 so that it engages notch 74 when both links are so aligned. A leaf spring 76 proximate to its one end is riveted as at 77 to a side 78 of link 69, with a lip 79, FIG. 6*a*, at its free end which projects through a small hole 80 in link 69. Lip 79 extends into another small hole 81, FIGS. 6*a*, 6*b*, in link 67 to lock both links 67, 69 together in the open mode for manufacture 15.

To release such alignment, a depressible button 82 (shown in phantom, FIG. 6*a*) riveted to leaf spring 76, is depressed from the other side (not visible) of link 69 so that lip 79 is removed from hole 81 in link 67, thus releasing links 67, 69 from one another so that they can be folded to each other to effect a collapse of arms 50, against or towards panel 20, making for ease and quickness of portability of manufacture 15.

Figure 9:
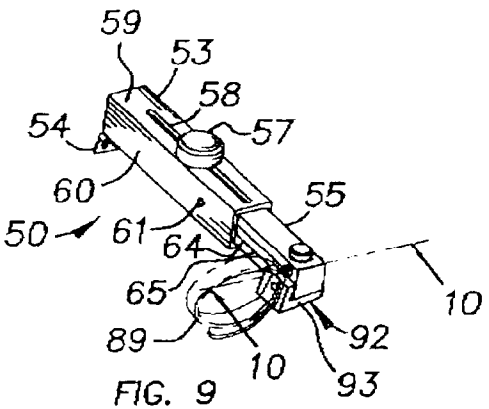
FIG. 9 is a perspective view of a telescopic arm like that of FIG. 7 but with its bracket and strap arrangement turned 90 degrees to its position shown in FIG. 7.

A strap assembly 83, FIG. 4, suitably securely mounts, FIGS. 4, 7, 9, to the open end of each arm 50, here on its telescopic tubing 55, and by which panel 20 adjacent its upper or top boundary 47 is connected to a corresponding rack bar 84, 85 atop a roof 86, FIGS. 1, 2, of vehicle 16, or to a suitable element(s) on a static structure. It should be noted that in the use of the strap assemblies 83, that arms 50 extend to points between standards 87 which are secured to roof 86 so that each pair of strap assemblies 83 for the respective pairs of bars 84, 85 do not fall off of the ends of the rack bars when applied to them. Each strap assembly 83 includes a buckle-and-belt-like arrangement 88, FIG. 4, that can be made smaller and larger so that its strap 89 can encircle the particular size of its corresponding rack bar 84, 85 atop of vehicle 16. An end of the strap assembly 83 is suitably secured, such as by riveting, to a leg 91 of an L-shaped bracket 92 that is rotatably mounted about its corresponding second tubing 55. As today's rack bar units on vehicles are found to be oriented either longitudinally of the vehicle or across the width of the vehicle's roof 86, manufacture 15 includes this rotatable feature for each L-shaped bracket 92 by which its strap 88 can encircle either a longitudinally-oriented rack bar 84, FIG. 1, or a width-oriented rack bar 85, FIG. 2.

Figure 8:
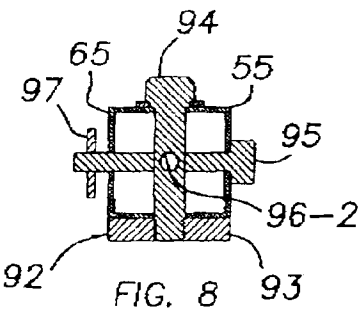
FIG. 8 is a view taken on line 8—8 of FIG. 7.

FIG. 8 illustrates how a threaded bolt 94 vertically extends through each second tubing 55 to attach to the other leg 93 of its bracket 92 at the bottom of the tubing 55. A second fastener 95 passes through a central hole 96-1 (FIG. 10) of bolt 94 and is held in position by a cotter pin 97 mounted along flat side 65 of tubing 55.

Figure 10:
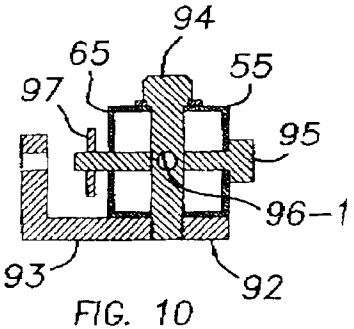
FIG. 10 is a view taken on line 10—10 of FIG. 9.

FIG. 10 illustrates the re-positioning of L-shaped bracket 92 after it has rotated 90 degrees from its setting in FIG. 8, thereby providing for a strap assembly 83 to encircle rack bars 85, FIG. 2, which extend across the width of roof 86 of vehicle 16.

Cotter pin 97 is first removed from fastener 95, and fastener 95 removed from tubing 55, so that L-shaped bracket 92 turns 90 degrees to its location illustrated in FIGS. 9 and 10. Bolt 94 includes a second bore 96-2 (FIG. 8) crossing bore 96-1 to accommodate such relocation by the same bolt 94. Fastener 95 and cotter pin 97 are again applied to tubing 55 through bore 96-2, FIG. 8, to securely relocate bracket 92 in its setting illustrated in FIG. 10.

Brackets 98, FIGS. 3, 4 may be suitably securely mounted to the top boundary of a support panel 20 for the addition of one or more lighting fixtures (not shown) that are to be utilized for lighting up display 19 during dark or night hours, utilizing current that is available to today's vehicles 16.

Figure 15:
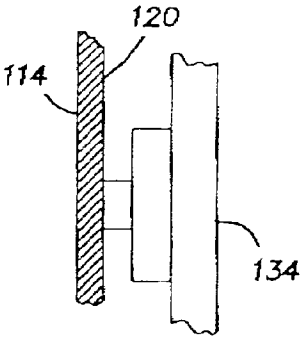
FIG. 15 is an enlarged schematic view of a suction cup product secured to the rearwall of the support panel of the FIG. 11 embodiment.

After fabrication of panels 17, 20, U-shaped frame 22, endless gasket 25, hinges 27, closure brackets 33, 34, and closure mechanism 31, they are connected or attached to the panels, using ordinary techniques with known manual and power tools used by today's craftsmen. As to the fabrication of arms 50, with or without their telescoping tubings 55, suction cup members 44, 45 (along with that illustrated in FIG. 15), and braces 62 are available through the McMaster-Carr Company, 9630 Norwalk Blvd, from the Rack Attack LLP Company, 1737 SW Morrison St., Portland Oreg. 97205, items 202082 and 22222.

FIGS. 11–15 illustrate another embodiment of the invention. A display manufacture 110 is illustrated as being mounted to a tailgate 111 of a vehicle 112. Embodiment 110 includes a transparent panel 113 and its support panel 114. Metal strips (not visible) riveted to a frame 115 about its boundaries retains transparent panel 113 in place in its frame 115. A frame 116 can also be endless for support panel 114. A set of suitable conventional hinges 117 swingably mount panels 113,114 to one another along their one longer lengths of boundaries in an ordinary fashion. A pair of strong (difficult to cut or break), yet flexible or bendable, bands 118 in the form of tough strips or bands, preferably metallic, are each pivotally secured by rivets 119 or other suitable fasteners to the exterior rearwall 120 of support panel 114. The substance or material of each band 118 is sufficiently flexible to curving its length in use so that its length wraps around or loops about a boundary 123 of tailgate 111, here its top, to extend adjacently along a sufficient distance of interior wall panel 124 of tailgate 111. A member 125 having an elongated aperture 126 is suitably secured to an end of its band 118 adjacent its free end for clasping to its corresponding closure member 127 securely mounted to the interior panel 124 of tailgate 111, thus connecting its band 118 to tailgate 111. Each closure member 127 preferably takes the form of a suitable locking device having its base 128 securely screwed to interior tailgate panel 124, with a rotatable elongated latch 129 that rotates with a turn of a key (not shown) on the cylinder of device 127, thus locking latching member 125 and its band 118 to tailgate 111. Panels 113, 114 are held in their closed mode by means of a cabinet-type locking fastener 130, FIG. 13, or other suitable closure member, suitably installed in frame 115 of transparent panel 113, FIGS. 15, 16, its latch (not visible) projecting through a slot 132, FIGS. 13, 13*a*, formed in the frame 116 of support panel 114 to lock frames 115, 116 together in the closed mode for manufacture 110. A key (not shown) to cabinet lock fastener 130 turns its latch from the exterior side of frame 115 of transparent panel 113. A pair of suction-cup members 134, one schematically illustrated in FIG. 15, which may be the kind as employed in the preceding described embodiment, are suitably spacedly secured to the exterior wall 120 of support panel 114 proximate to the lower boundary of display manufacture 110 and in their customary application to the outside wall or panel 136, FIG. 11, of tailgate 111 connects the lower portion of manufacture 110 to the tailgate. Sealing gaskets can be applied by suitable adhesives to the interior wall of support panel 114 to provide a sealed condition for a display leaf inserted between panels 113, 114 of manufacture 110 in the manufacture's closed mode, should such gaskets be as much desirable as was illustrated in the earlier described embodiment. The elements described in regard to the second embodiment are readily fabricated out of the same materials and as products utilized in the preceding described embodiment to produce manufacture 110, the fabrication being carried out by known techniques and procedures in production of display panels.

Turning to FIGS. 16–19, these FIGURES illustrate another embodiment of the invention. It should be understood that in the following description, references made to elements and connections in the FIG. 11–15 embodiment, although not illustrated in these FIGS. 16–19, are to be understood as being included within this embodiment and are to be integrated into and as part of the following description and drawing FIGURES of this embodiment, along with elements and connections disclosed in the earlier embodiments that are required for operational value of the FIGS. 16–19 embodiment, such as but not limited thereto, both support and transparent panels, the hinges for swingably joining together both panels, a locking or other closure member to maintain a closure mode for the panels, etc.

Figure 12:
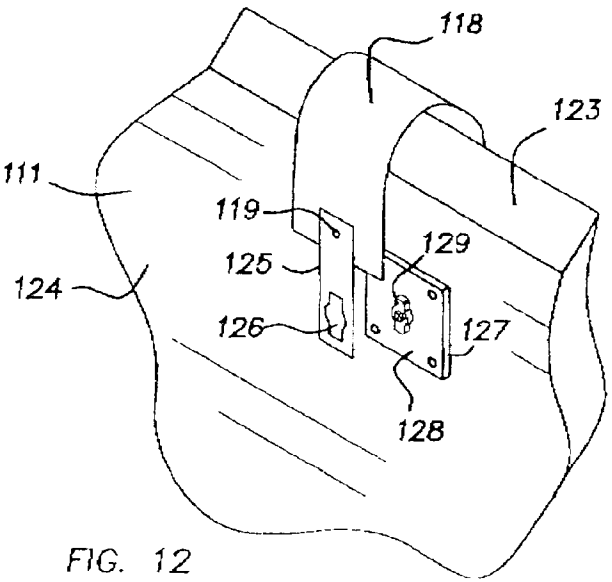
FIG. 12 is a perspective enlarged fragmentary view above and from the inside of the tailgate illustrated in FIG. 11.
Figure 14:
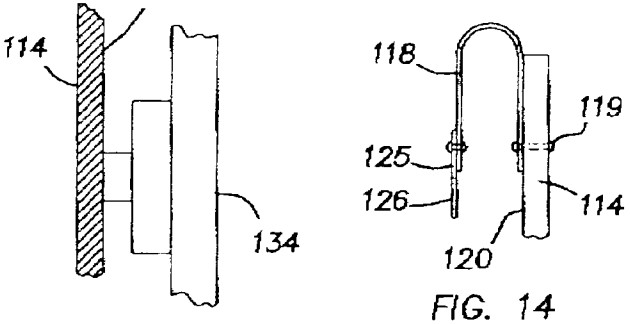
FIG. 14 is a fragmentary elevational view, partly in section, showing an arm mounted to the rearwall of the support panel of the FIG. 11 embodiment.
Figure 13A:
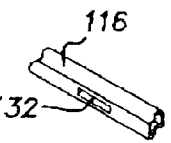
FIG. 13*a* is an fragmentary enlarged view of portions of elements illustrated in FIG. 13.
Figure 13:
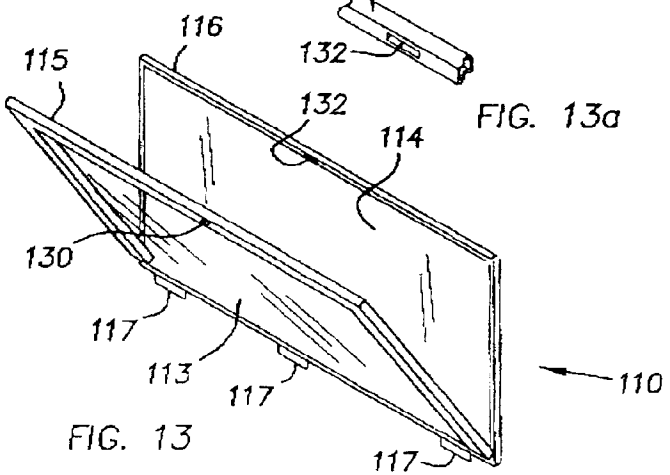
FIG. 13 is a perspective view from above the manufacture illustrated in the embodiment of FIG. 11, its assembled panels being shown in an open manner relative to each other.
Figure 17:
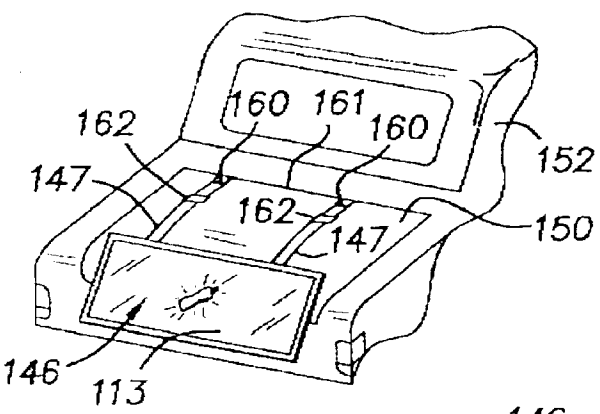
FIG. 17 is a perspective view of the FIG. 16 embodiment illustrating its mode of operation or application to the closed lid of a trunk at the rear of a vehicle.
Figure 19:
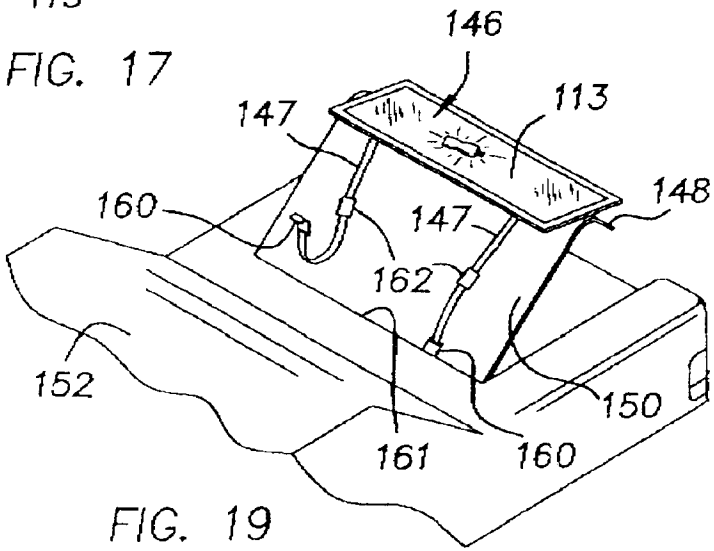
FIG. 19 is another perspective view of the FIG. 16 embodiment, illustrating the way of completing the connection of such embodiment to the top edge of the trunk's lid.
Figure 16:
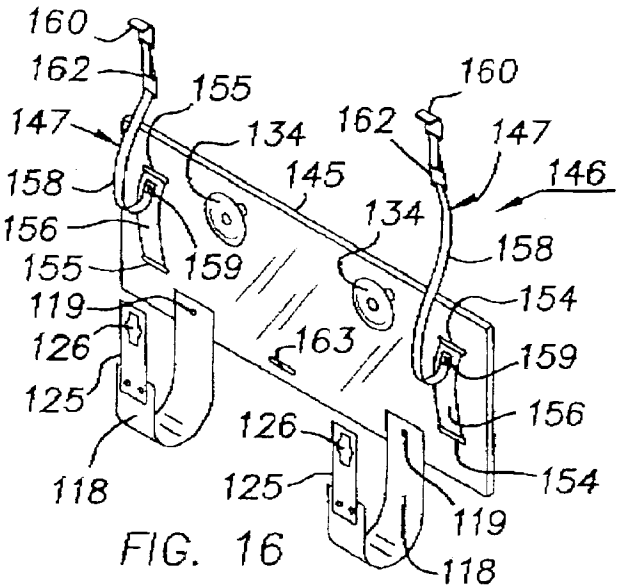
FIG. 16 is a perspective view of another embodiment of the invention that includes the support panel of the supporting assembly of elements of the FIG. 10–15 embodiment of the invention, but otherwise changed for utilization on a rear trunk lid of a vehicle.

A support panel 145, FIG. 16, of an embodiment 146, FIGS. 16–19, including flexible bands 118, and with or without suction-cup members 134 as they are not operational in the employment of this embodiment, is provided with a pair of spaced strap assemblies 147 that take the place of suction-cup members 134 in operation of embodiment 146. Support panel 145 is hinged to a transparent panel (like 113) in the same or similar and conventional manner as in the earlier described embodiments, however, the operational position of embodiment 146 is inverted over that of embodiment 110 illustrated in FIGS. 11–15, so that in its operational position flexible bands 118 loop around or about a boundary, such as the bottom edge 148, FIG. 18, of a trunk lid 150 with its top 151 at the rear of a vehicle 152, in a firm operational mode in the use of this embodiment. The elements 125–126 of FIG. 12 are incorporated into this embodiment as part of each band 118, with elements 127–129, FIG. 16, being suitably securely mounted to the interior wall 149, FIG. 18, of the trunk lid 150, for operative connection of this embodiment to the trunk lid 150. Two (2) pairs of spaced slots 154, 155, FIG. 16, are formed through the thickness of support panel 145 so that a suitable member 156, FIG. 16, say, fabric in nature, encircles both sides of support panel 145 through its corresponding pair of slots 154, 155. Each of the pair of strap assemblies 147 are assembled, such as by stitching, to their respective elements 156 along the back wall of panel 145 as illustrated in FIG. 16. Each strap assembly 147 includes a strap 158, FIG. 16, having a first end 159 stitched or otherwise secured to encircling member 156 and a second end at which a (plastic) hook member 160 is suitably firmly attached, such as by stitching, to the strap's second end for gripping a top edge 161 of trunk lid 150. A suitable conventional adjusting buckle assembly 162, FIGS. 16, 17, 19, is included within the length of each strap 158 as part of its own assembly 147 for adjusting the length of each strap assembly. The adjusting of the length of each strap assembly 147 during embodiment 146's installation to lid 150 provides for a firm grip to trunk lid 150 for the embodiment so that it is held snugly to the lid's top edge 161 in the lid's normal closure to the body of vehicle 152.

Figure 18:
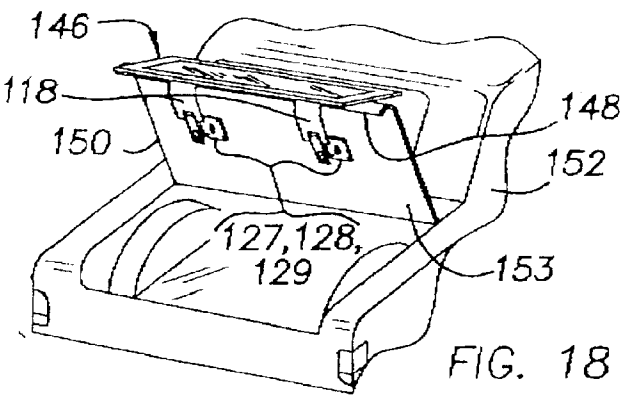
FIG. 18 is a perspective view showing one way in which the FIG. 16 embodiment begins to be connected to the trunk's lid that is in an open mode.

In operation, flexible bands 118 with their members 125 and apertures 126 grasp or close upon elements 127, 128, 129, FIG. 18, in the same manner as in the earlier described embodiments, securely mounting bands 118 to the interior wall 149 of trunk lid 150, while each hook member 160 grips the boundary or top edge 161 of trunk lid 150 of vehicle 152. Buckle assemblies 162 are adjusted so that slack in the length of strap assemblies 147 is removed and a snug and firm connection between this embodiment and vehicle 152 is attained, the transparent display panel 113, FIGS. 17, 19, being, of course, part of this embodiment visible to the viewer. A handle 163 in the form of a finger-sized slot is located along the bottom and in the center of panel 145 whereby embodiment 146 may be portably carried.

Figure 22:
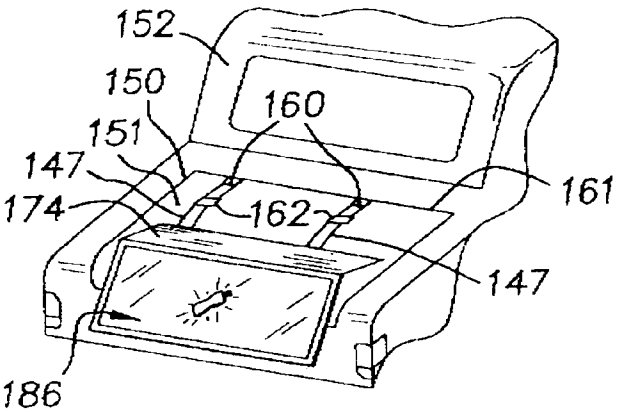
FIG. 22 is a perspective view of the embodiment of FIG. 20 illustrating its mode of operation or application to the closed lid of a trunk at the rear of a vehicle.
Figure 21:
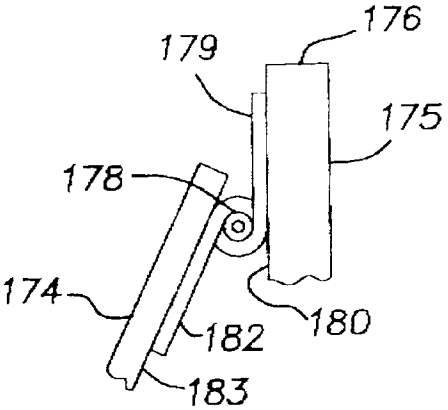
FIG. 21 is a diagrammatic view taken on arrow line 21 of FIG. 20.
Figure 20:
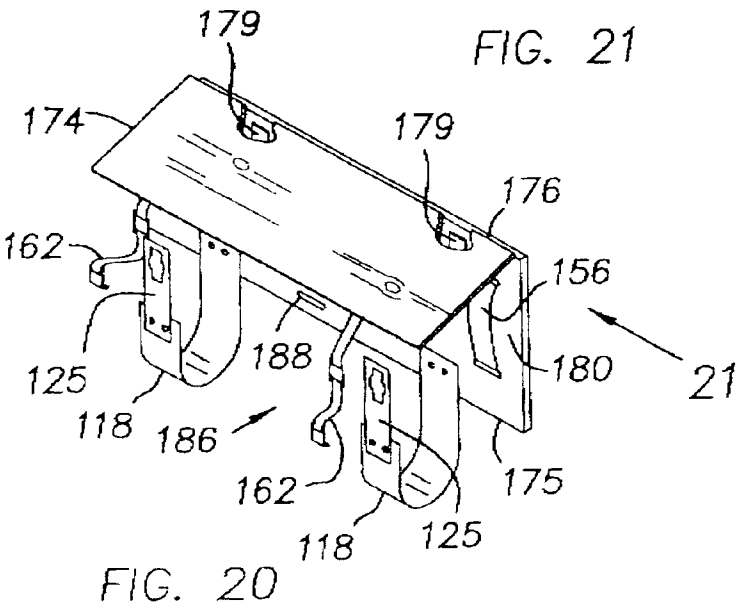
FIG. 20 is a perspective view, partly broken away, of an alternative embodiment of the FIGS. 16–19 embodiment of the invention, illustrating a wind-deflection panel securely connected to the support panel of the assembly of supporting elements of the display manufacture and shown in a partially open mode.

FIGS. 20, 21, 22 illustrate an embodiment by which the direction of wind forces applied to a moving vehicle is altered by deflecting them from entering the space between the vehicle's rear trunk lid and the manufacture connected to it. The reduction or elimination of such wind forces contributes to further safe use of the manufacture as wind forces while the vehicle is moving along a roadway could possibly separate the manufacture from the vehicle. The safety of other persons and their vehicles which may be following the vehicle is assured. This embodiment utilizes the embodiment illustrated by FIGS. 16–19 in its invention and for its operational value.

FIG. 20 illustrates a wind deflecting panel 174 connected to a support panel 175 along the latter's top edge 176 by means of conventional coiled spring hinges 178, FIG. 21, one of which is schematically illustrated in FIG. 21. Two or more hinges 178 are spacedly located along edge 176 their one corresponding ends 179, FIGS. 20, 21, suitably attached to a rear wall 180 of support panel 175 and their other corresponding ends 182, FIG. 21, being suitably attached to the interior wall 183, FIG. 21, of wind deflecting panel 174, such attachment maintaining the two (2) panels together in this manufacture 186. Suction cups 134 of the previously described embodiments need not be included in this embodiment although strap assemblies 147, adjustable buckles 162 mounted as at 159, FIG. 16, and members 118, etc. are a part of this embodiment, FIG. 20, and included in manufacture 186, FIGS. 20, 22, in the same manner as in manufacture 146. A hand-carrying handle 188, FIG. 20, in the form of a slot in support panel 175, is provided for portably carrying manufacture 186 in its closed mode, i.e., panel 174 being in a collapsed position next to support panel 175 by reason of bias in coiled spring hinges 178.

In operation, FIG. 22, after hook members 160 are fit to the top edge 161 of a rear trunk lid 150 of a vehicle 152, as in one of the previously described embodiments, wind deflecting panel 174, from its closed mode to support panel 175, as in the previously described embodiment, is swung open against the bias of coiled spring hinges 178 to an obtuse angle relative to the plane of support panel 175 so that its free edge 189 abuts top 151 of the trunk's lid 150, FIG. 22. Members 118 are locked onto locking devices 127, 128, 129 (not visible here) within the interior of the trunk's lid 150 after which strap assemblies 147 are adjusted in their lengths by manipulating buckles 162 so that manufacture 186 is firmly mounted in position on top of trunk lid 150. Wind deflecting panel 174 may be formed from any suitable lightweight sturdy material such as plastic or wood and fabricated into a size complementing that of its mated support panel 175, with planar dimensions suitable to the configuration of the top 151 of the trunk lid 150.

It now should be apparent that the invention, not necessarily limited to the illustrated embodiments themselves, is applicable to a static structure as well as to vehicles having unit rack bars, tailgates, and trunk lids. The arms or bands 118 and strap assembly 147, together with elements 125–129 can be attached or connected about boundaries in the static structure not necessarily of the natures of the boundary or top 123 of tailgate 111 and the boundaries or top edge 161 and bottom edge 148 of a vehicle but openings such as slots in the static structure through which bands 118 can project and be fastened to the structural formation of the static structure by suitable closure devices exemplified by elements 125–129. Bands 118 in a flattened-out condition with elements 125, 126 also could be used in embodiments to connect to closure devices mounted on a wall or the like of a static structure, i.e., of a non-vehicular nature, against which embodiments are employed in addition to being looped around or through or directly attached to a wall of a panel or the like. Even strap assemblies 83 and their equivalents are adaptable to application to such a static structure.

Figure 24:
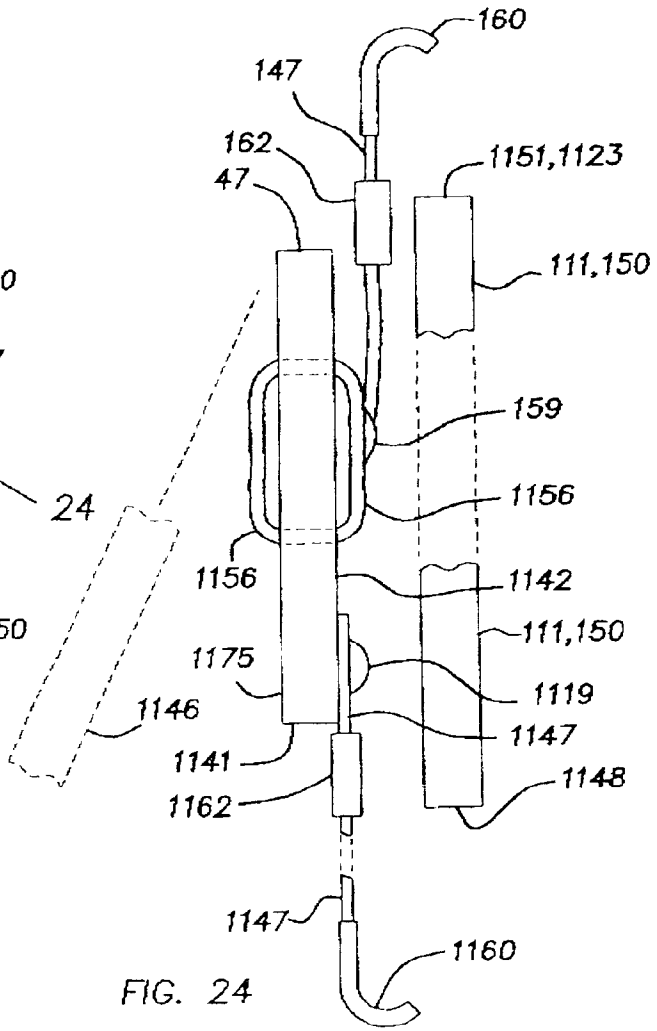
FIG. 24 is a diagrammatic view taken along line 24—24 of FIG. 23.
Figure 23:
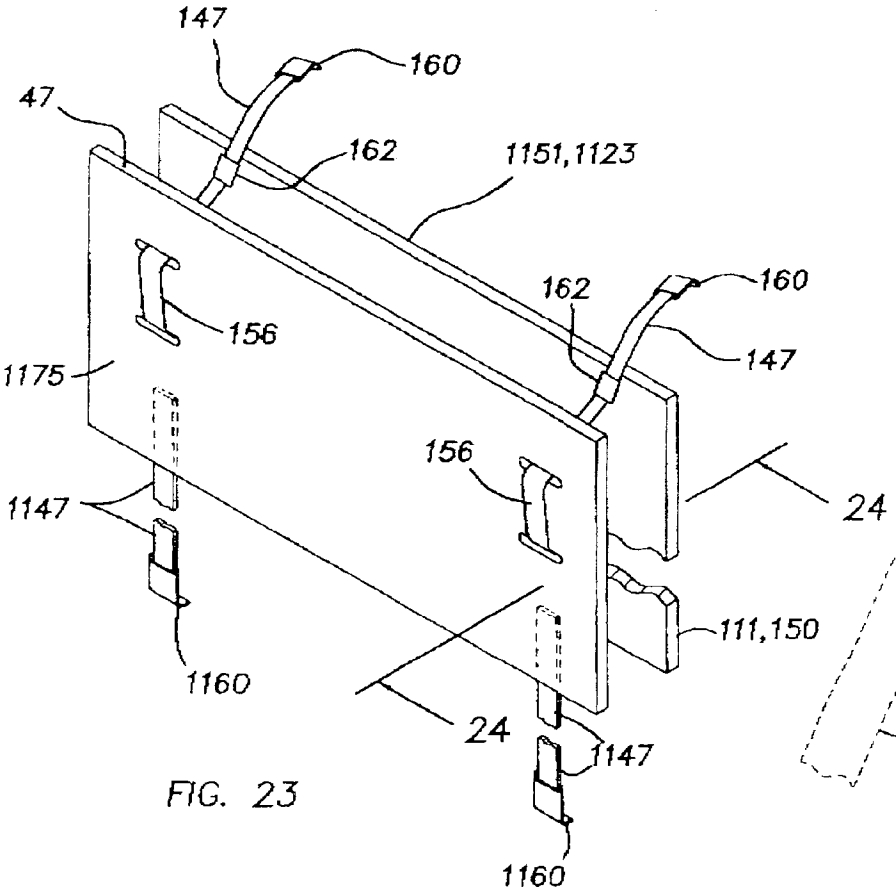
FIG. 23 is a perspective view of another embodiment of the invention.

FIGS. 23 and 24 illustrate another embodiment of the invention. Strap assemblies 147, together with adjustable (the adjustability being optional and in other embodiments as well) buckle assemblies 162, hook members 160, and encircling members 156 are utilized adjacent to a top boundary 47 of a back or support panel 1175 to which a transparent panel 1146, FIG. 24, is operatively connected in a suitable manner or as exemplified above in other illustrated embodiments. Adjacent to a bottom boundary 1141, FIG. 24, of support panel 1175, another set of strap assemblies 1147 (with or without adjustable buckle assemblies 1162, FIG. 24), and attached hook members 1160 thereto are suitably connected to a backwall 1142, FIG. 24, of support panel 1175, as at rivets 1119, FIG. 23, (or even by alternative encircling members 1156 of strap assemblies 1147, illustrated in FIG. 24). Hook members 1160 grasp the bottom edge 1148, FIG. 24, of either a tailgate 111 or trunk lid 150 (in the other embodiments) while hook members 160 grasp the upper edge 1151 or 1123 of either the tailgate 111 or trunk lid 150.

It now should be apparent that the embodiments of FIGS. 11–15 and FIGS. 23, 24 may be utilized on a tailgate and on a rear trunk lid as an integrated single device on their corresponding types of vehicles, i.e., interchangeable between them without substantially or essentially changing their own physical make-ups.

Figure 25:
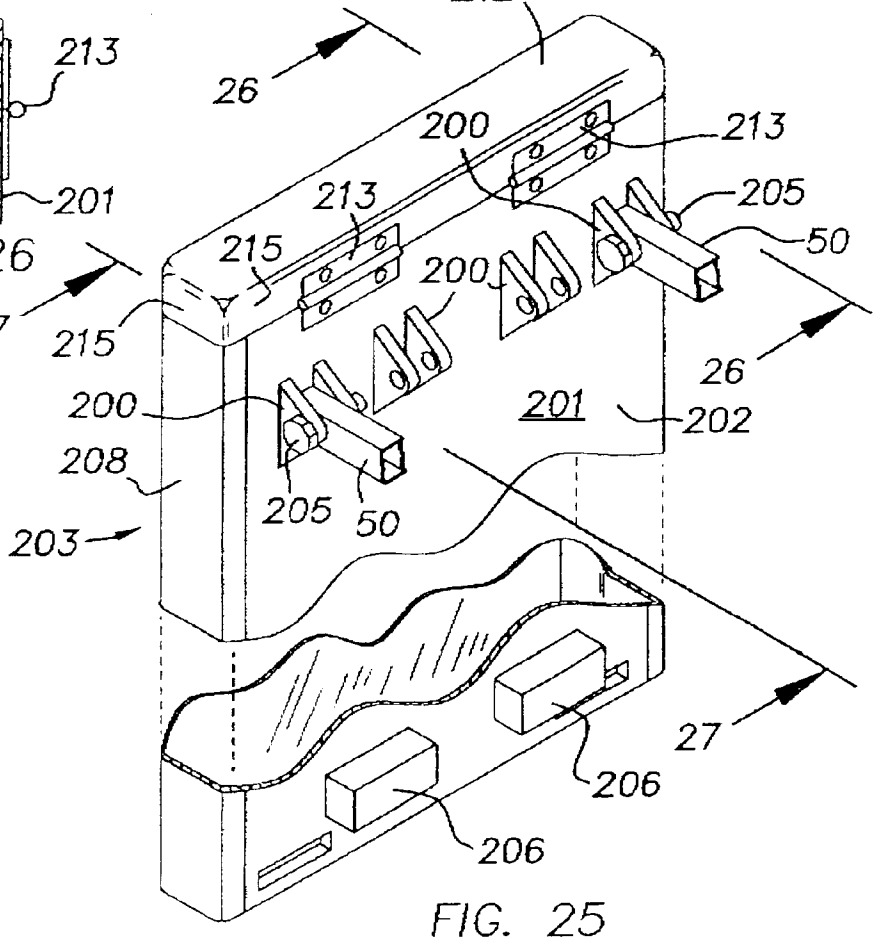
FIG. 25 is a perspective view of another embodiment of the invention.
Figure 26:
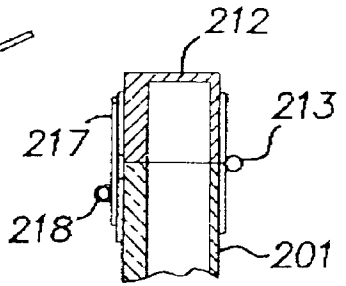
FIG. 26 is a view taken on line 26—26 of FIG. 25.
Figure 27:
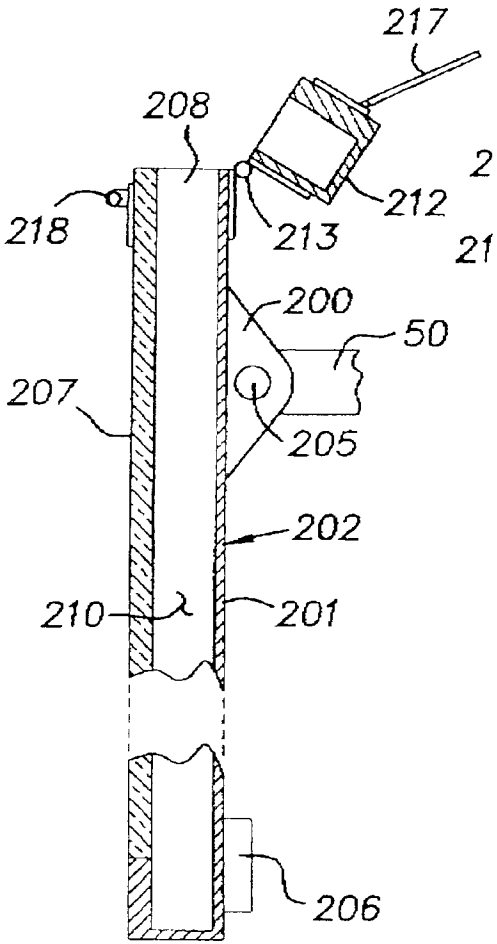
FIG. 27 is a view taken on line 27—27 of FIG. 25, modified by its cap being open from its closed mode in FIGS. 25 and 26.

FIGS. 25, 26, 27 illustrate yet another embodiment of the invention. It should be understood that elements described above and as illustrated in FIGS. 1–10 and other embodiments are incorporated by reference to the illustrations of FIGS. 25, 26, and 27, and as described or mentioned in the following description directed to this embodiment. A plurality of pivotal mounts 200, usually in spaced pairs, is securely fastened to and adjacent to upper boundaries of a rearwall 201 of a support panel 202 of a display manufacture 203. Rather than being hinged to support panel 202, each of arms 50 (FIGS. 1–10) is pivotally mounted by nutted bolts 205 to a selected pair of pivotal mounts 200 to rearwall 201 of manufacture 203, with the remaining elements illustrated in FIGS. 1–10 being in connected tandem to arms 50, so that manufacture 203 may be adapted or applied to vehicle 16 by way of rack bars 84, FIG. 1, or rack bars 85, FIG. 2, as are the embodiments illustrated in FIGS. 1–10. Adjacent to lower boundaries of rearwall 201, FIG. 27, which oppose the upper boundaries of rearwall 201 is a pair of attached spaced elements 206 for connecting lower dimensions of display manufacture 203 to a sidewall 46 of vehicle 16. Elements 206, though shown in diagrammatic fashion, represent suction cups such as those 44, 45 in the FIGS. 1–10 embodiment and as applied to vehicle 16 connect the lower dimensions of manufacture 203 to a sidewall 46 of the vehicle. Connecting elements 206 also represent elements such as magnets or other suitable elements attached to rearwall 201 for connecting lower dimensions of manufacture 203 to a sidewall 46 of a vehicle 16. Display manufacture 203 is produced in (box-like, for example) conventional manner, forming support panel 202, a transparent panel 207, FIG. 27, and sidewalls 208 which join together the support and transparent panels 202, 207. A cavity 210, preferably shallow in depth, is formed as well, separating panels 202, 207 from one another by the widths of sidewalls 208, the cavity 210 sufficient in depth to accommodate a display leaf, such as a display leaf 18. One of the sidewalls 208, such as the top one, is substantially omitted for ingress and egress of a display leaf 18 while instead a cap or cover 212 is hinged as at 213, FIG. 26, to the backside 201 of support panel 202. The sidewall formations 215 of cap 212, upon the latter's closing about support panel 202, and upon transparent panel 207 and sidewalls 208, are in alignment with such panels 202, 207 and sidewalls 208. Cap 212 is maintained in a closed mode by means of a closure member 217 attached to cap 212 and which closes upon its mated closing member 218, FIG. 26, attached to transparent panel 207.

Figure 28:
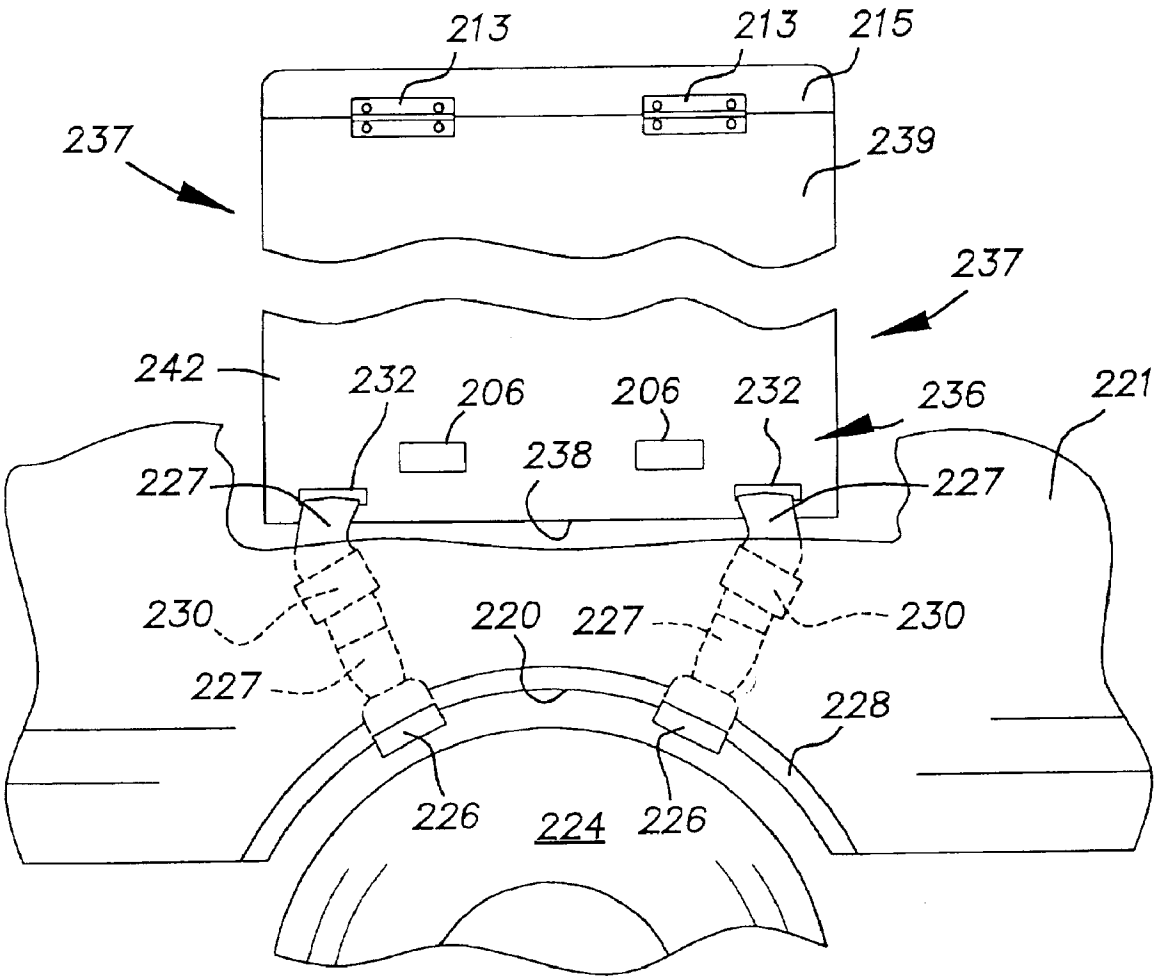
FIG. 28 is a schematic elevational view illustrating another embodiment of the invention, taken from a viewpoint within a wheel well of a vehicle.

The schematic FIG. 28 illustrates another embodiment of the invention. Viewing FIG. 28 from the interior of a wheel well 220, formed in a vehicle's side panel 221, and which wraps or curves around in a customary manner exteriorly of a wheel-and-tire assembly 224, a pair of elements 226, such as hooks or clamps, each suitably securely fastened to one end of its corresponding strap 227 spacedly grasp a lip 228 of wheel well 220. An adjustable buckle assembly 230 provides for lengthening or shortening each strap 227. Each strap 227 is looped about a slot 232 in a back panel 236 of a display manufacture 237 and suitably formed adjacent to a bottom boundary 238 of back panel 236 or to a similar slot 232 in any one of the back panels illustrated in the earlier described embodiments. The upper portion 239 of a back panel 236 of amanufacture 237 is adapted to connect, for example, to a vehicle in any one of the manners disclosed in FIGS. 1–27. A bottom portion 242 of back panel 236 is applied, such as by abutment, against the exterior wall of side panel 221. Each hook 226 is manually caused to grasp lip 228 of wheel well 220. The length of each strap 227 is adjusted by adjusting the portions in its buckle assembly 230 to achieve a tight or snug retention of back panel 236 and its display manufacture 237 against the exterior wall of side panel 221. Magnets or suction cups 206 can be suitably securely mounted to back panel 236 to grip the exterior wall of vehicle panel 22 1in the event straps 227 are not available at the moment of use of a display manufacture. Straps 227 and straps of other embodiments embrace substitution of VELCRO™ material as well as suitable fabric.

Various changes and modifications can be made in embodiments of the invention without departing from its spirit and scope. Arms 50 need not be telescopic in nature. Suitable closure members, of locking or unlocking nature, on all embodiments of the invention may be utilized other than mechanism 31, FIG. 5, and cabinet lock 130, FIG. 13. Gasket 25 can be securely mounted in proximity to the perimeter of the inside surface of support panel 20, with a metal frame strip attached to the perimeter of panel 17, so that the two abut each other to seal manufacture 15 in its closed mode. Hinges 117 may be secured to the short sides or other boundaries of the panels of embodiments as well. The pivot at rivet 119, FIG. 12, need not be pivotal, but member 125 may be non-pivotal to band 118, as illustrated in FIG. 22. The swingable mounts, such as the hinges 27 between the panels and as illustrated in FIGS. 3, 4, can be mounted on other opposing boundaries for the panels, for example, along the upper and lower boundaries of the rectangular manufacture 15, and along the side or shorter boundaries of manufacture 110. Elements 205, FIG. 25, may be suction cups or other suitable attaching devices for any embodiment of the invention. In the embodiment of FIG. 28, although not limited thereto, one or three (3) or more straps 227, with or without adjusting buckle assemblies 230, and with a corresponding hook or hooks 223 can be used. The invention also embraces the support assembly itself, a support assembly with a display manufacture having support and transparent panels, and a support assembly with only a back panel on which a display 18 may be suitably securely mounted thereon. Suitable means, other than hooks or clamps, can be substituted for them where illustrated in the above and in other embodiments of the invention to serve the same function.

INDUSTRIAL APPLICABILITY

The subject matter of the invention is applicable to other classes of art where display needs arise.

I claim:

1. A display assembly for attachment to a vehicle comprising:

a panel assembly for receiving a display leaf; and a strap assembly connected to the panel assembly, removably attached to a roof rack of the vehicle, and removably hanging the display assembly from the vehicle, such that the panel assembly extends downwardly along a side of the vehicle, wherein the direction of travel of the vehicle is substantially in the vertical plane of the panel assembly.

2. The display assembly of claim 1, wherein the panel assembly comprises a first panel and a second panel having a gap therebetween for receiving the display leaf.

3. The display assembly of claim 2, wherein the first panel is transparent.

4. The display assembly of claim 2, further comprising a cap connected to the panel assembly and movable from a closed position, wherein the gap is enclosed such that the display leaf is secured within the panel assembly; and an open position, wherein the gap is exposed to allow the display leaf to be removed from the panel assembly.

5. The display assembly of claim 2, further comprising a cap that is pivotally connected to the panel assembly and moveable between a closed position wherein the gap is enclosed; and an open position wherein the gap is exposed.

6. The display assembly of claim 1, further comprising a mounting arm assembly extending from the panel assembly and connected to the strap assembly.

7. The display assembly of claim 6, wherein the mounting arm assembly is telescoping.

8. The display assembly of claim 6, wherein the mounting arm assembly is pivotally connected to the panel assembly.

9. The display assembly of claim 7, wherein the mounting arm assembly comprises an inner arm movable relative to an outer arm to vary a length of the mounting arm assembly.

10. The display assembly of claim 9, wherein varying the length of the mounting arm assembly varies a distance between the strap assembly and the panel assembly.

11. The display assembly of claim 6, wherein the strap assembly is pivotally mounted to the mounting arm assembly.

12. The display assembly of claim 1, wherein the strap assembly completely encircles a rail of the roof rack to secure the display assembly to the vehicle.

13. The display assembly of claim 1, further comprising a support member connected to the panel assembly and disposed between the panel assembly and the side of the vehicle, wherein the support member comprises a non-abrasive surface for contacting the side of the vehicle.

14. The display assembly of claim 13, wherein the support member is a suction cup which forms a removable coupling with the side of the vehicle.

15. The display assembly of claim 13, wherein the support member is a magnet which forms a removable coupling with the side of the vehicle.

16. The display assembly of claim 1, wherein the strap assembly forms an enclosure that removably encircles a portion of the roof rack to mount the display assembly to the vehicle, and wherein the strap assembly comprises a closure mechanism that secures the enclosure around said portion of the roof rack.

17. The display assembly of claim 1, wherein the strap assembly forms an enclosure of an adjustable size that removably encircles a portion of the roof rack to mount the display assembly to the vehicle, and wherein the strap assembly comprises a closure mechanism that secures the enclosure around said portion of the roof rack and maintains the size of the enclosure at a desired size.

18. A display assembly for attachment to a vehicle comprising:

a panel assembly for receiving a display leaf;

a mounting arm extending from the panel assembly; and a strap assembly connected to the mounting arm, removably attached to a roof rack of the vehicle, and removably hanging the display assembly from the vehicle, such that the panel assembly covers at least a portion of a side panel of the vehicle, wherein the mounting arm is used to vary a distance between the panel assembly and the roof rack.

19. The display assembly of claim 18, wherein the panel assembly comprises a transparent first panel and a second panel having a gap therebetween for receiving the display leaf.

20. The display assembly of claim 19, further comprising a cap that is pivotally connected to the panel assembly and moveable between a closed position wherein the gap is enclosed; and an open position wherein the gap is exposed.

21. The display assembly of claim 18, wherein the mounting arm assembly is telescoping.

22. The display assembly of claim 18, wherein the mounting arm assembly is pivotally connected to the panel assembly.

23. The display assembly of claim 21, wherein the mounting arm assembly comprises an inner arm movable relative to an outer arm to vary a length of the mounting arm assembly.

24. The display assembly of claim 18, wherein the strap assembly is pivotally mounted to the mounting arm assembly.

25. The display assembly of claim 18, wherein the strap assembly completely encircles a rail of the roof rack to secure the display assembly to the vehicle.

26. The display assembly of claim 18, further comprising a support member connected to the panel assembly and disposed between the panel assembly and the side panel of the vehicle, wherein the support member comprises a non-abrasive surface for contacting the side panel of the vehicle.

27. The display assembly of claim 26, wherein the support member is a suction cup which forms a removable coupling with the side panel of the vehicle.

28. The display assembly of claim 26, wherein the support member is a magnet which forms a removable coupling with the side panel of the vehicle.

29. The display assembly of claim 18, wherein the strap assembly forms an enclosure that removably encircles a portion of the roof rack to mount the display assembly to the vehicle, and wherein the strap assembly comprises a closure mechanism that secures the enclosure around said portion of the roof rack.

30. The display assembly of claim 18, wherein the strap assembly forms an enclosure of an adjustable size that removably encircles a portion of the roof rack to mount the display assembly to the vehicle, and wherein the strap assembly comprises a closure mechanism that secures the enclosure around said portion of the roof rack and maintains the size of the enclosure at a desired size.

* * * * *